United States Patent [19]

Sekine

[11] 4,398,460

[45] Aug. 16, 1983

[54] PRINTER

[75] Inventor: Kazumi Sekine, Kawasaki, Japan

[73] Assignee: Canon Kabushiki Kaisha, Tokyo, Japan

[21] Appl. No.: 256,134

[22] Filed: Apr. 21, 1981

[30] Foreign Application Priority Data

Apr. 24, 1980 [JP] Japan ..... 55-55217

[51] Int. Cl.[3] ..... B41J 1/50; B41J 27/14

[52] U.S. Cl. ..... 101/93.15; 101/93.11; 101/93.17; 101/93.29; 101/110

[58] Field of Search ..... 101/110, 103, 93.09, 101/93.11, 93.15, 93.16, 93.17, 93.28, 93.29, 205

[56] References Cited

U.S. PATENT DOCUMENTS

| | | | |
|---|---|---|---|
| 3,734,012 | 5/1973 | Huggins | 101/93.29 |
| 3,874,285 | 4/1975 | Kodaira et al. | 101/93.28 |
| 4,240,345 | 12/1980 | Kyogokn | 101/110 |
| 4,250,807 | 2/1981 | Kondo et al. | 101/93.09 |
| 4,337,697 | 7/1982 | Aoki et al. | 101/93.11 |

FOREIGN PATENT DOCUMENTS

| | | | |
|---|---|---|---|
| 176855 | 5/1953 | Austria | 101/205 |
| 55-114572 | 9/1980 | Japan | 101/93.15 |
| 1,409,676 | 10/1975 | United Kingdom | 101/108 |

*Primary Examiner*—William Pieprz

*Attorney, Agent, or Firm*—Fitzpatrick, Cella, Harper & Scinto

[57] ABSTRACT

A printer having plural type font wheels for function symbols of different colors and plural type font wheels for numerals of different colors fitted on a rotary shaft, wherein the plural type font wheels for numerals are displaced along the shaft for each printing action. The plural type font wheels for function symbols or for numerals are provided with a mask for exposing only one type font wheel of a desired color but covering all other wheels to enable multi-color printing. The selection of the type font wheel for printing is achieved by the displacement of plural type font wheels in the digit direction with respect to the mask.

8 Claims, 9 Drawing Figures

PRINTER

BACKGROUND OF THE INVENTION

1. Field of the Invention

The present invention relates to a multi-color printing mechanism for a serial printer for use in a desk-top electronic calculator and the like.

2. Description of the Prior Art

There are already known printers capable of two-color printing, for example as disclosed in the U.S. Pat. No. 3,734,012, but such printers have been complex and large-sized in structure.

SUMMARY OF THE INVENTION

The object of the present invention is to provide a serial printer capable of multi-color printing.

Another object of the present invention is to provide a serial printer compact in size and simple in structure.

Still another object of the present invention is to provide a simplified color selection mechanism.

Still other objects of the present invention will become apparent from the following detailed description thereof.

DETAILED DESCRIPTION OF THE PREFERRED EMBODIMENTS

Figure 1:
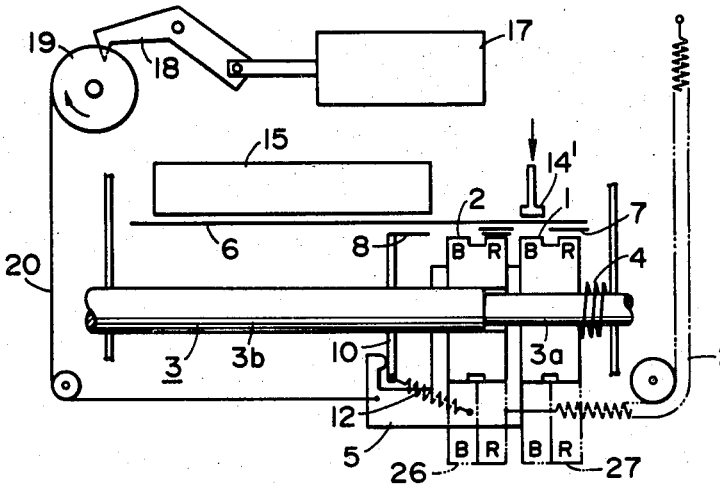
FIGS. 1, 2 and 3 schematic views showing the position of the type font wheel in an embodiment of the printer of the present invention.
Figure 2:
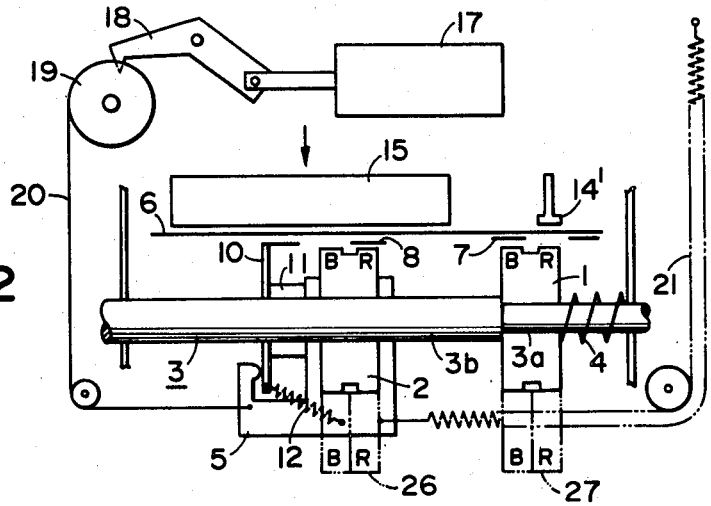
Figure 3:
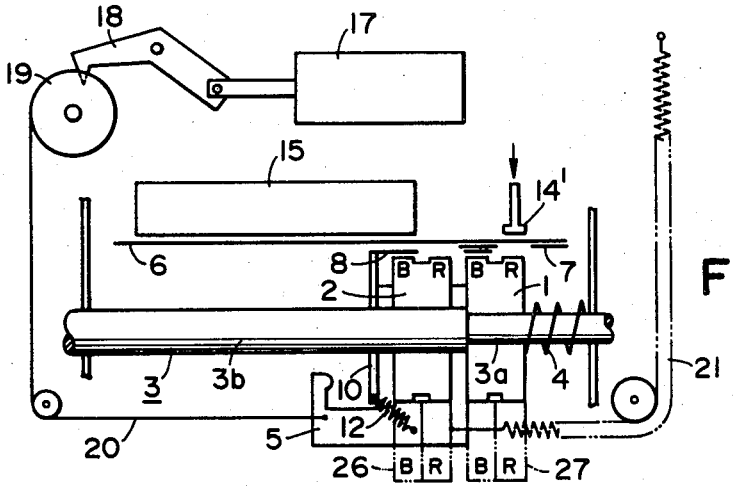
Figure 4:
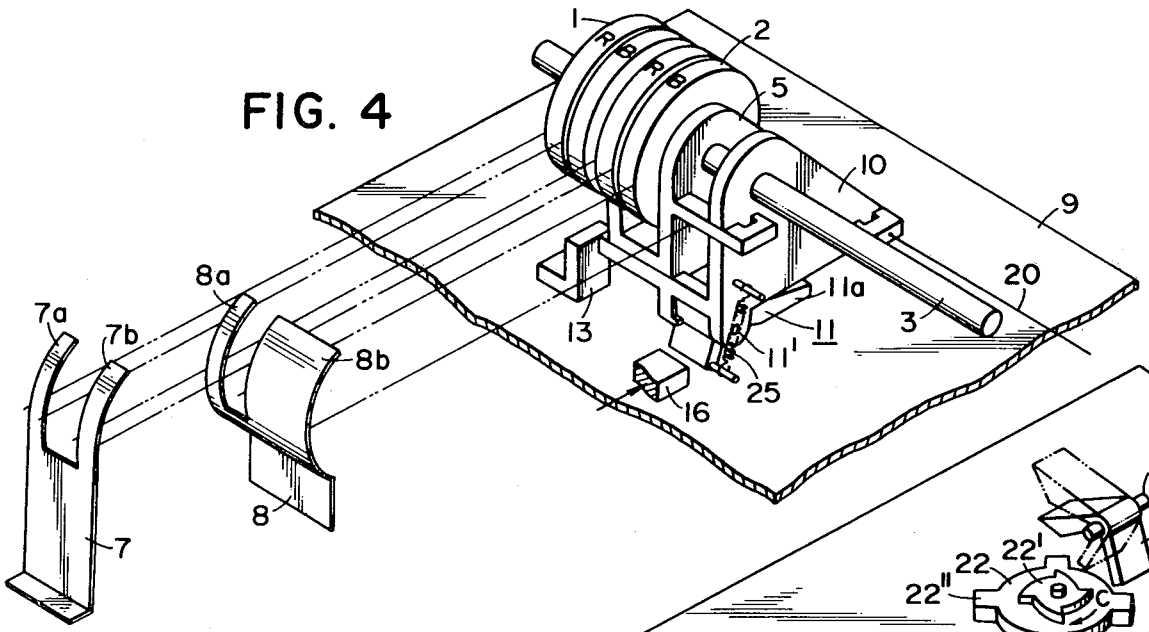
FIG. 4 is a perspective view of the type font wheel and the associated mechanisms of an embodiment of the printer of the present invention.

FIGS. 1 to 3 are schematic views showing the printing action of an embodiment of the printer of the present invention wherein the printing colors are assumed as black (B) and red (R). In FIG. 1 there is shown a type font wheel 1 for function symbols having a black type ring (B) and a red type ring (R) which are mutually spaced by a distance not shown equal to the pitch between the digits and which are respectively provided along the periphery thereof with type fonts of function symbols in paired form, and a type font wheel 2 for numerals having a black type ring (B) and a red type ring (R) which are mutually spaced by the distance and are respectively provided along the periphery thereof with the type fonts of numerals in paired form, wherein the type font wheels 1 and 2 are shown in the home positions thereof and in the cross sections thereof for clarifying the form of a shaft 3 therein. Said type font wheels 1, 2 are fitted on said shaft 3 and rendered slidable along said shaft 3 but rotatable therewith by means of a longitudinal groove formed on said shaft. Said shaft 3 is provided with a smaller diameter portion 3*a* on which said type font wheel 1 for function symbols is fitted and a larger diameter portion 3*b* on which said type font wheel 2 for numerals is fitted, whereby said type font wheel 1 is prevented from leftward displacement by the shoulder on said shaft 3. The type font wheel 1 for function symbols is constantly biased to the left by a compression coil spring 4, and is maintained, as shown in FIG. 1, in contact with a type font wheel holder 5 for rotatably holding said type font wheel 2 for numerals and displacing the same along the shaft 3. The type font wheels 1, 2 are respectively associated with a fixed mask 7 and a movable mask 8 for selectively shielding the black type ring (B) or red type ring (R) from a printing paper 6. In FIG. 1, the red type rings (R) are shielded by said masks. As shown in FIG. 4, the mask 7 or 8 is provided in the central portion thereof with a notch of a width P and on both sides thereof with masking portions of a width P or larger. In FIG. 4 the type font wheels 1, 2 are in the home positions as in FIG. 1, wherein the mask 7 is so shaped as to shield the red type ring (R) of the type font ring 1 for function symbols and the red type ring (R) of the type font ring 2 for numerals, respectively, by the mask portions 7*a* and 7*b*, while the mask 8 is so shaped that the mask portion 8*a* shields the red type ring (R) of said type font wheel 2 and the mask portion 8*b* is idle in the state shown in FIG. 1 or FIG. 4 but shields the black type ring (B) of the type font wheel 2 for numerals when it is displaced by a digit to the left with respect to the mask 8 as shown in FIG. 3. Said fixed mask 7 is fixed by the frame 9 of the printer, while said movable mask 8 is fixed by a mask holding member 10, whereby said mask 8 alone is displaced together with said mask holding member 10. The mask holding member 10 is rendered, independently from the type font wheel holder 5, displaceable along the shaft 3, whereby the mask 8 is displaceable with respect to the type font wheel 2 and is capable of selectively shielding the red type ring (R) or black type ring (B) of said type font wheel 2. The mask holding member 10 and the type font wheel holder 5 are connected to each other through a tension coil spring 12 which is provided to make them pull each other. The distance between said type font wheel holder 5 and the mask holding member 10 is determined by a substantially L-shaped spacer 11 which is pivotably supported on a spacer shaft 11' under said mask holding member 10 and of which extremity 11*a* is inserted between the type font wheel holder 5 and the mask holding member 10 for separating these two members as shown in FIG. 2, or retracted to allow mutual contact of these two members under the function of a tension coil spring 12. The spacer 11 can be inserted between the type font wheel holder 5 and the mask holding member 10 only when the type font wheel holder 5 is in the home position as shown in FIG. 4. It is because the space into which the spacer 11 can be inserted is formed between the type font wheel holder 5 and the mask holding member 10 by the contact of the mask holding member to a stopper 13 fixed on the frame 9 only when the type font wheel holder 5 is in the home position.

Therefore, a space between the type font wheel holder 5 and the mask holding member 10 is kept at the thickness of the spacer 11 by the insertion of the spacer when the type font wheel holder is moving to the left direction in FIG. 1. In this condition, a red type ring (R) of the type font wheel 2 having numerals is shielded by a mask portion 8*a* formed on the mask 8, and only a black type ring (B) is permitted to print its numerals. If the spacer 11 is not inserted between the type font wheel holder 5 and the mask holding member 10 when the type font wheel holder is in the home position, the type font wheel holder and mask holding member, as shown in FIG. 3, contact each other to move together to the left direction shown in FIG. 1. Therefore, the black type ring (B) of the type font wheel 2 for numerals is always shielded by a mask portion 8a formed on the mask 8, and as a result, only the type ring (R) is permitted to print numerals.

Figure 5:
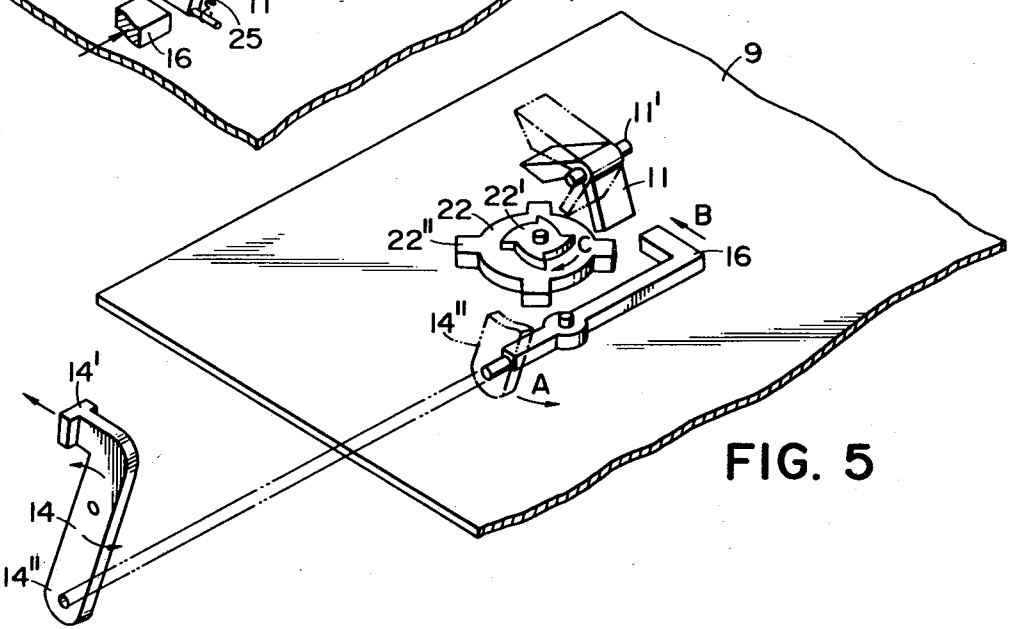
FIG. 5 is a perspective view of the mechanism in said embodiment.

As explained in the foregoing, the spacer 11 has a function for determining whether the red type ring (R) or the black type ring (B) is used for printing. Again in FIG. 1 there are provided hammer heads 14' and 15 respectively for function symbols and numerals, wherein the hammer head 14' is at first activated once and the hammer head 15 is then activated for printing several digits. More specifically, in the present embodiment, the hammer head 14' is used solely for printing the right-end function. The driving mechanism for said hammer heads 14', 15 and the character selecting mechanism for the type font wheels are already known and are therefore omitted from the present description. FIG. 1 shows the positions of the type font wheel immediately before the black printing of a function symbol. A black function symbol alone is printed on the printing paper 6 by the hammer head 14' since the red type ring (R) of the type font wheel 1 and the red type ring (R) of the type font wheel 2 are shielded by the mask 7 fixed to the frame 9 shown in FIG. 4. In synchronization with the striking action of the hammer head 14' toward the type font wheel 1 as shown in FIG. 5, a linked spacer hammer 16 hits the spacer 11 to cause a pivoting thereof about the spacer shaft 11', whereby said spacer is inserted between the type font wheel holder 5 and the mask holding member 10 to define the relative relationship of the movable mask 8 and type font wheel 2 along the shaft 3. The type font wheel 5 is shifted by electromagnetic plunger 17 and as a result, the spacer 11 is supported by the mask holding member 10 and the type font wheel holder 5, just after the spacer is inserted between the type font wheel holder and the mask holding member. After the printing of the function symbol in FIG. 1, an electromagnetic plunger 17 is energized to displace, by means of a ratchet 18, a take-up drum 19 with ratchet wheel and a cable 20, the type font wheel holder 5, type font wheel 2, mask holding member 10 and movable mask 8 fixed thereto to the left by one digit, whereby the black type ring (B) of the type font wheel 2 becomes positioned at the right-hand end of the hammer head 15 to perform the black printing of a numeral of the lowermost digit by the action of said hammer head 15. Subsequently, the electromagnetic plunger 17 is again energized to displace the type font wheel 2 and associated member to the left by one digit. FIG. 2 shows a state after the printing of a certain number of numerals. The type font wheel 1 for function symbols is biased to the left by the compression coil spring 4 and is maintained in contact with the shoulder portion of the shaft 3 wherein the red type ring (R) thereof faces the hammer head 14', but the red printing of function symbol does not take place since the hammer head 14' is not activated until the completion of printing of numerals in a line. Upon completion of printing of numerals, the ratchet 18 is liberated from the take-up drum 19, whereby the type font wheel holder 5, type font wheel 2 for numerals, mask holding member 10 and movable mask 8 are returned to the home position shown in FIG. 1 by means of a tension coil spring 21. In this state the type font wheel 1 is also returned to the position shown in FIG. 1 against the function of the coil spring 4.

Also at the returning of said type font wheel 2 etc. by means of the coil spring 21 after the completion of printing, an unrepresented ratchet provided on the bottom of said type font wheel holder 5 rotates a ratchet wheel 22' integral with a spacer retracting wheel 22 in a direction C (a ¼ turn in the present embodiment), whereby a spacer retracting pin 22'' returns the spacer 11 to the full-line position in FIG. 5.

In the state shown in FIG. 1 the mask holding member 10 is biased to the right by the tension coil spring 12, but a space for the spacer 11 is secured by the stopper 13 as shown in FIG. 4.

Now FIG. 3 shows the positions of type font wheels in the red printing, wherein the electromagnetic plunger 17 is energized to displace the type font wheel holder 5 to the left by one digit, through the ratchet 18, take-up drum 19 and cable 20. In this state the hammer head 14' is not activated, so that the spacer 11 is not inserted between the type font wheel holder 5 and the mask holding member 10, and the space therebetween is removed by the function of the tension coil spring 12. Also the type font wheel 1 for function symbols, though not being pulled by the plunger 17, slides to the shoulder of the shaft 3 under the function of compression coil spring substantially simultaneously with the displacement of the type font wheel 2, whereby the red type rings (R) of both type font wheels are exposed in the notched portions of the masks 7 and 8, as shown in FIG. 3. Subsequently, the hammer head 14' is activated to perform the red printing of a function symbol. Simultaneously the spacer 11 is activated by the spacer hammer, but it stops in a position in contact with the bottom of the type font wheel holder. It is because the space into which the spacer 11 can enter is not provided due to the previous shift of the type font wheel holder. Further, at this time, in the spacer 11 and spacing hammer 16, however the stress is absorbed by their elasticity. Thereafter, the displacement and printing are repeated in the same manner as in the black printing, but, because of the absence of spacer, the black type ring (B) of the type font wheel 2 is shielded by the movable mask 8, thus allowing red printing. After the completion of the printing the spacer 11 returns to the original position which is not between the type font wheel holder 5 and the mask holder 10 by means of the aforementioned ratchet mechanism, and a space is formed between the type font wheel holder 5 and the mask holding member 10 by means of the stopper 13 in FIG. 4 to restore the state shown in FIG. 1.

Figure 6A:
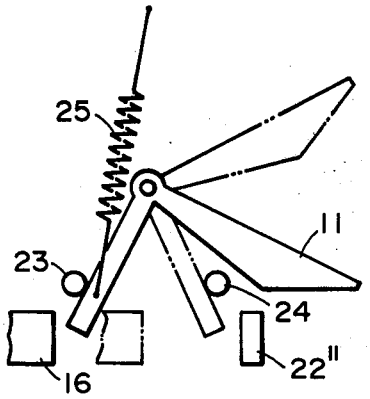
FIG. 6 is a view showing the state of spacer in said embodiment.
Figure 6B:
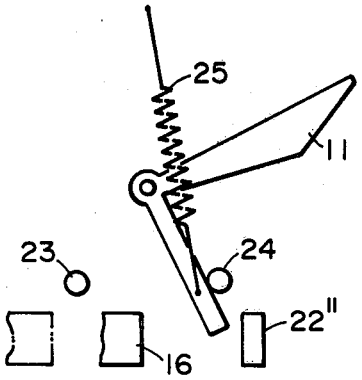
Figure 6C:
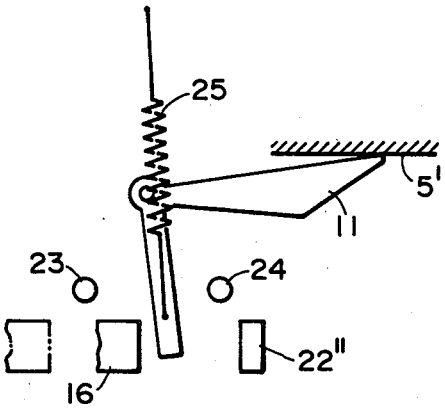
Figure 6D:
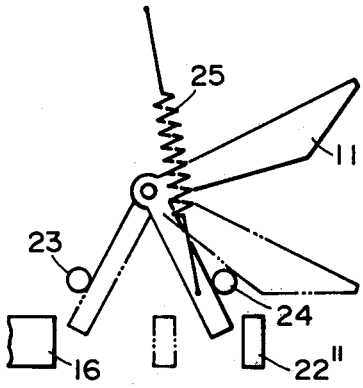

FIG. 6 shows various states of the spacer 11, wherein stopper 23, 24 formed integral with the mask holding member 10 supports, in cooperation with a tension coil spring 25, the spacer in the full-line or chain-lined position shown in FIG. 6A, except in the case of red printing. The spacer 11, maintained in the full-lined position in FIG. 6A prior to the action of the spacer hammer 16, is displaced to the position shown in FIG. 6B by said spacer hammer 16. In case of red printing, the spacer stops in a position shown in FIG. 6C even after the action of the spacer hammer, being hindered by the bottom 5' of the type font wheel holder. After the completion of printing, the spacer in the inserted position as shown in FIG. 6D is returned to the chain-lined position therein or the position shown in FIG. 6A by the displacement of the spacer retracting pin 22'' toward the broken-lined position simultaneously with the returning of the type font wheel holder 5 to the position shown in FIG. 1.

Although not specifically explained in the foregoing, ink supply means such as ink rollers 25, 26 shown in FIGS. 1–3 are suitably so mounted as to integrally displace with respective type font wheels.

It will be understood that the present invention is by no means limited to the foregoing embodiment. For example it is possible to dispense with the type font wheel for function symbols, or to drive the spacer 11 by means of the hammer head 15 instead of 14'. It is furthermore possible to print three or more colors instead of two colors explained in the foregoing. For example it is possible to obtain n colors by employing masks each having a central notch of a width approximately equal to said pitch P and lateral masking portions of a width at least equal to $(n-1)\times P$ and $n-1$ spacers.

What I claim is:

1. A printer, comprising:

a type font wheel mounted on a shaft and having a plurality of type font rings mounted on and arranged along the shaft for printing in respective different colors;

a mask for simultaneously shielding all but a selected one of said plurality of type of font rings from a printing paper, and for exposing said rings one at a time;

means for striking a type provided on the exposed type font ring to imprint a character on the printing paper;

means for moving said type font wheel together with said mask along the shaft; and means for changing a relative position between said type font wheel and said mask to permit said exposure of said rings one at a time.

2. A printer according to the claim 1, wherein said mask is provided with a notch for exposing only one type font ring of said type font wheel to the printing paper.

3. A printer according to claim 1, wherein said changing means comprises;

a holding member for supporting said type font wheel;

a mask holding member for supporting said mask; and spacing means selectively insertable into a space between said mask holding member and said type font wheel holding member.

4. A printer according to claim 3, wherein said spacing means is adapted to be inserted into the space between said mask holding member and said type font wheel holding means by means of a spacing hammer to be activated in cooperation with said hitting means.

5. A printer, comprising:

a type font wheel mounted on a shaft and having a plurality of type font rings mounted on and arranged along the shaft at a predetermined pitch;

means for striking the type fonts of said type font rings selectively to imprint characters on a printing paper; and a shielding mask positioned between said type font wheel and the printing paper and provided with a notch of a width approximately equal to said predetermined pitch, for masking portions extended on both sides of the notch over a width at least approximately equal to the predetermined pitch$\times$n (n being an integer);

means for supporting said type font wheel and said shielding mask to permit changes in their relative positions; and means for moving said supporting means together with said type font wheel and shielding mask along the shaft.

6. A printer according to the claim 5, further comprising means for displacing said type font wheel by the predetermined pitch with respect to said shielding mask.

7. A printer, comprising;

a type font wheel mounted on a shaft and having a plurality of type font rings for printing in respective different colors; wherein said rings provide side-by-side rows of characters;

a mask having a notch for exposing only a selected one of said plurality of type font rings to a printing paper, and for shielding all of the other type font rings from the paper;

means for displacing character-by-character a holder which rotatably supports said type font wheel and said mask along the shaft;

a hammer for striking selected type fonts of said type font wheel to imprint characters on the printing paper; and means for positioning a said type font ring of a desired color opposite to the notch of said mask when aligned for operation with said hammer.

8. A printer according to claim 7, wherein said positioning means comprises:

a spacer for being selectively inserted in a space between said type font wheel holder and said mask for moving the mask axially of the shaft to position the notch of said mask at a desired type font ring of said type font wheel; and spacing hammer means for operation to insert said spacer into the space between said type font wheel holder and said mask.

* * * * *

UNITED STATES PATENT AND TRADEMARK OFFICE

CERTIFICATE OF CORRECTION

PATENT NO. : 4,398,460

DATED : August 16, 1983

INVENTOR(S) : KAZUMI SEKINE

It is certified that error appears in the above-identified patent and that said Letters Patent is hereby corrected as shown below:

Column 4, line 33, after "time", insert --stress occurs--.

Column 6, line 27, after "colors" delete ";".

Signed and Sealed this

*Twenty-ninth* Day of *November 1983*

[SEAL]

*Attest:*

GERALD J. MOSSINGHOFF

*Attesting Officer*

*Commissioner of Patents and Trademarks*